US008648791B2

(12) United States Patent
Lin et al.

(10) Patent No.: US 8,648,791 B2
(45) Date of Patent: Feb. 11, 2014

(54) BACKLIGHT MODULE AND METHOD OF DETERMINING DRIVING CURRENT THEREOF

(75) Inventors: Su-Yi Lin, Hsin-Chu (TW); Hsin-Wu Lin, Hsin-Chu (TW); Ming-Chien Lin, Hsin-Chu (TW)

(73) Assignee: AU Optronics Corp., Science-Based Industrial Park, Hsin-Chu (TW)

( * ) Notice: Subject to any disclaimer, the term of this patent is extended or adjusted under 35 U.S.C. 154(b) by 748 days.

(21) Appl. No.: 12/725,469

(22) Filed: Mar. 17, 2010

(65) Prior Publication Data

US 2011/0157238 A1 Jun. 30, 2011

(30) Foreign Application Priority Data

Dec. 29, 2009 (TW) ..... 98145540 A

(51) Int. Cl.
*G09G 3/36* (2006.01)

(52) U.S. Cl.
USPC ..... 345/102

(58) Field of Classification Search
USPC ..... 345/102, 690, 204; 362/97.1, 97.2
See application file for complete search history.

(56) References Cited

U.S. PATENT DOCUMENTS

2006/0022616 A1* 2/2006 Furukawa et al. ..... 315/309
2006/0125773 A1 6/2006 Ichikawa
2007/0085816 A1* 4/2007 Evanicky et al. ..... 345/102
2008/0238860 A1* 10/2008 Onodera ..... 345/102
2009/0179848 A1 7/2009 Schmidt
2009/0225567 A1* 9/2009 Mori et al. ..... 362/612
2009/0243504 A1* 10/2009 Cho et al. ..... 315/251
2009/0289965 A1 11/2009 Kurokawa
2010/0020267 A1* 1/2010 Kobayashi et al. ..... 349/64
2010/0134406 A1* 6/2010 Maruyama et al. ..... 345/102
2010/0245711 A1* 9/2010 Kubota et al. ..... 349/61

FOREIGN PATENT DOCUMENTS

CN 1721943 A 1/2006
CN 101533606 A 9/2009
TW 200630708 9/2006
TW 200935393 8/2009

OTHER PUBLICATIONS

Safa Kasap, pn Junction Devices and Light Emitting Diodes, http://www.kasap.usask.ca/samples/pnjunctiondevices.pdf, Apr. 10, 2001.
Steven Keeping, Identifying the Causes of LED Efficiency Droop, http://www.digikey.com/us/en/techzone/lighting/resources/articles/identifying-the-causes-of-led-efficiency-droop.html, Oct. 18, 2011.
Michael P. Liao, Carrier Concentration and Junction Temperature Dependencies of Illumination Efficiency of GaN Power Light-Emitting Diodes, http://ultralaser.iphy.ac.cn/cleo/data/papers/JTuA93.pdf, May 2007.

* cited by examiner

*Primary Examiner* — Pegeman Karimi
(74) *Attorney, Agent, or Firm* — Winston Hsu; Scott Margo

(57) ABSTRACT

A method of determining driving currents of a backlight module includes: disposing the backlight module onto a base; defining a plurality of areas from a top area to a bottom are of the backlight module; and reducing the driving current of the area that is situated further from the base.

1 Claim, 7 Drawing Sheets

| Driving current (mA) | | |
|---|---|---|
| 60 | 55 | 60 |
| 68 | 70 | 68 |
| 75 | 80 | 75 |

300

| | | |
|---|---|---|
| A1<br>421.2 nits<br>72.6° C | A2<br>416.2 nits<br>74.7° C | A3<br>413.6 nits<br>70.4° C |
| B1<br>477.4 nits<br>70.5° C | B2<br>501.7 nits<br>71.9° C | B3<br>468.3 nits<br>71.3° C |
| C1<br>486.6 nits<br>73.0° C | C2<br>514.4 nits<br>68.1° C | C3<br>472.8 nits<br>67.5° C |

210

220

| Driving current (mA) | | |
|---|---|---|
| 60 | 55 | 60 |
| 66 | 72 | 66 |
| 70 | 70 | 70 |

400

| | | |
|---|---|---|
| A1<br>414.5 nits<br>70.2° C | A2<br>414.4 nits<br>73.5° C | A3<br>408.2 nits<br>68.6° C |
| B1<br>471.2 nits<br>69.9° C | B2<br>505 nits<br>72.3° C | B3<br>461.9 nits<br>70.0° C |
| C1<br>476.7 nits<br>72.8° C | C2<br>503.4 nits<br>67.4° C | C3<br>463.8 nits<br>67.5° C |

210

220

| Driving current (mA) | | |
|---|---|---|
| 75 | 75 | 75 |
| 75 | 75 | 75 |
| 75 | 75 | 75 |
| PWM | | |
| 80% | 77% | 80% |
| 87% | 100% | 87% |
| 96% | 96% | 96% |

500

BACKLIGHT MODULE AND METHOD OF DETERMINING DRIVING CURRENT THEREOF

BACKGROUND OF THE INVENTION

1. Field of the Invention

The present invention is related to a method of determining the driving currents of a backlight module, and more particularly, to a method of determining the driving currents of a plurality of areas of the backlight module for circulating the temperature of the backlight module evenly.

2. Description of the Prior Art

LCD (Liquid Crystal Display) devices have gradually become the main stream display device due to the advantages of high display quality, radiation-free, and high spatial efficiency. The liquid crystal itself does not emit light, so the LCD device requires a backlight module for providing the light source required by the liquid crystal panel to display images.

The conventional backlight module comprises the light emitting component and the corresponding driver, wherein the driver comprises components such as the power transistor and the transformer. Heat of the backlight is generated when the driver is operating. In addition, the light emitting component also generates heat when emitting light. Consequently, such heat sources cause the temperature of the backlight module to rise. A gap exists between the light emitting component of the backlight module and the crystal panel for the purpose of light blending. The heat generated within the backlight module causes air convection between the gap. When the air of the lower part of the backlight module is heated due to the heat generated from the light emitting component and the driver, the air convection causes the hot air to flow upwards as the hot air consists of a lower density. As the upper part of the lamp holder is structurally sealed, heat is gradually accumulated as the hot air flows upwards, resulting in temperature difference between the upper part and the lower part of the internal of the backlight module. The accumulated heat affects the heat dissipating ability of the light emitting component and the driver of the backlight module, further influencing the light emitting efficiency of the backlight module.

Please refer to FIG. 1. FIG. 1 is a diagram illustrating the approximate temperature measurement of different areas of the LCD device according to the prior art. The LCD device 100 comprises a backlight module 110 and a base 120. Taking the vertical-structured LEDs (Light Emitting Diodes) as an example, the LEDs are distributed at the lower portion of the light emitting surface of the backlight module 110, the LCD device 100 is normally used perpendicular to the ground surface and the backlight module 110 is installed on the base 120. When the backlight module 110 is disposed vertically, the temperature of the LEDs of different areas of the backlight module 110 is varied such that the maximum temperature difference can reach up to tens of degrees Celsius (° C.). The temperature difference severely affects the lifetime of the LEDs of different areas of the backlight module 110, and generally the operating current of the LED is constrained by the maximum temperature of each area of the backlight module 110. The temperature difference between the lamp holders of different areas causes the optical film to inflate, as a result the optical film may become wavy and the display quality is degraded. Furthermore, after a period of usage, the brightness uniformity of the backlight module 110 is significantly varied as the LEDs of different areas are attenuated at different rates, consequently the display quality of the backlight module 110 is deteriorated severely.

SUMMARY OF THE INVENTION

An embodiment of the present invention discloses a method of determining driving currents of a backlight module. The method comprises disposing the backlight module perpendicularly, defining a plurality of areas from a top area to a bottom area of the backlight module; and reducing the driving current of the top area of the backlight module.

Another embodiment of the present invention discloses a method for determining driving currents of a backlight module. The method comprises defining a plurality of areas for the backlight module; disposing a temperature sensor close to each of the plurality of areas; and adjusting the driving current of the plurality of areas according to temperatures measured by the temperature sensors.

Another embodiment of the present invention discloses a backlight module. The backlight module comprises a light emitting module, a plurality of temperature sensors and a driver. The light emitting module comprises a plurality of light emitting areas. Each of the plurality of temperature sensors is disposed close to each of the plurality of light emitting areas, for measuring temperatures of the plurality of light emitting areas. The driver is electrically connected to the light emitting module and the plurality of temperature sensors, for generating driving currents for driving the light emitting module and adjusting the driving current according to the temperatures measured by the plurality of the temperature sensors.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
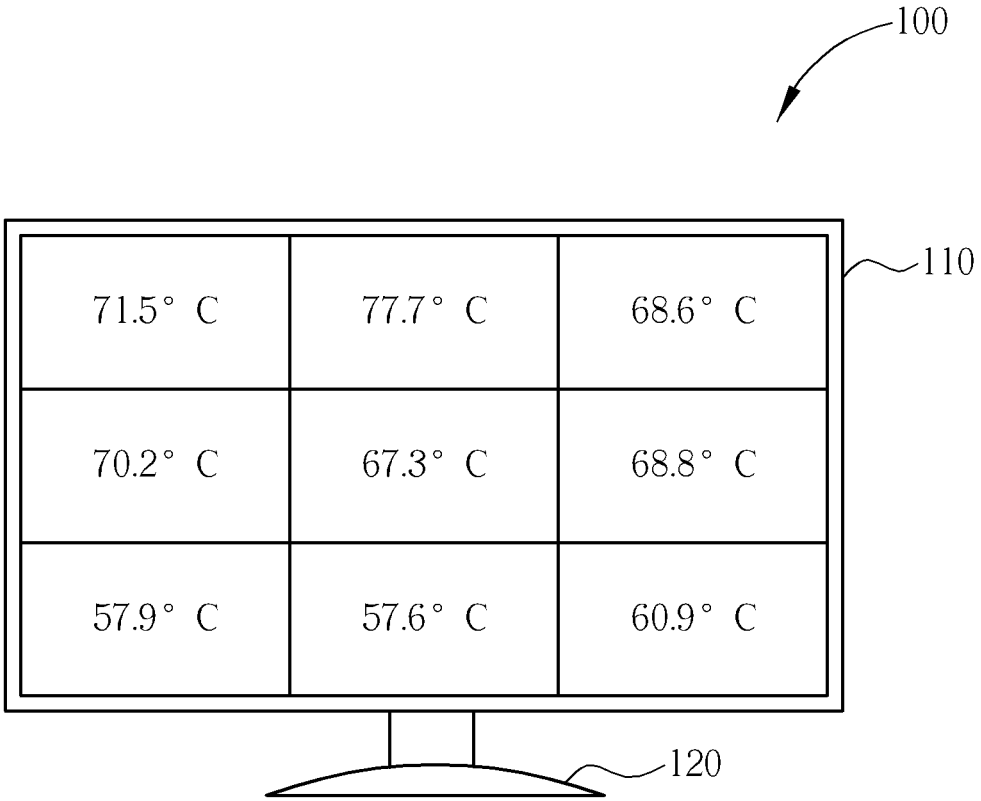
FIG. 1 PRIOR ART
FIG. 1 is a diagram illustrating the approximate temperature measurement of different areas of the LCD device according to the prior art.
Figure 2:
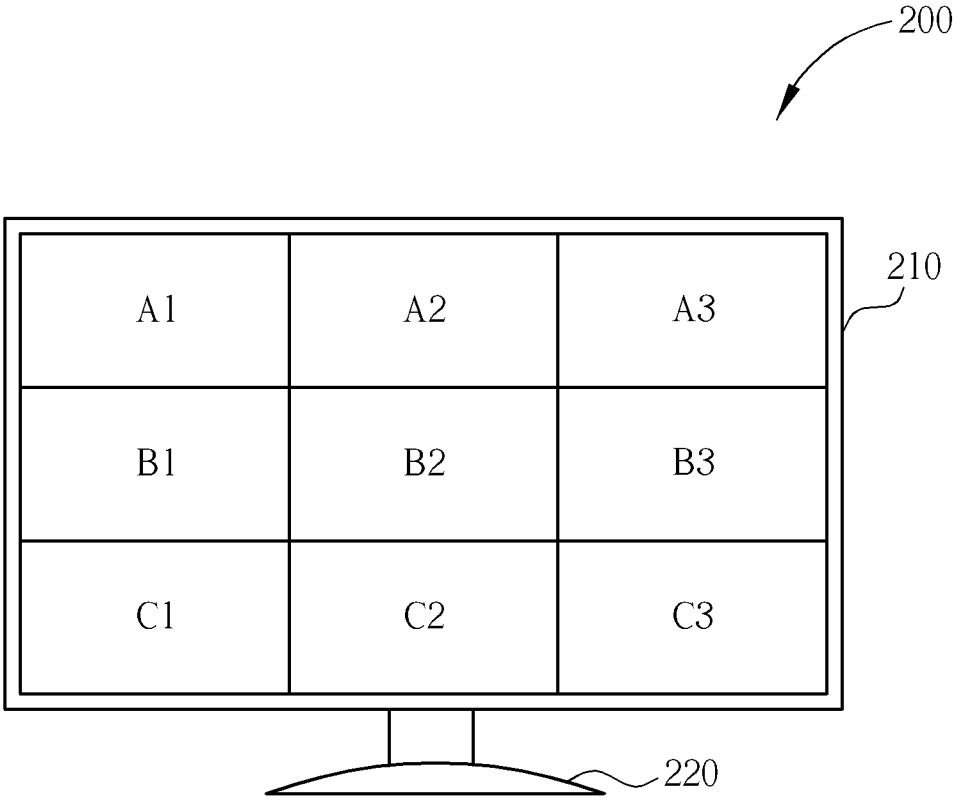
FIG. 2 is a diagram illustrating determining the driving currents of the backlight module according to the present invention.

Please refer to FIG. 2. FIG. 2 is a diagram illustrating determining the driving currents of the backlight module according to the present invention. The LCD device 200 comprises the backlight module 210 and the base 220. The backlight module 210 is installed on the base 220. When the backlight module 210 is perpendicular to the ground surface, a plurality of areas A~C are defined vertically from the top side to the bottom side of the backlight module 210, wherein the area A is situated further from the base 220 and the area C is situated closer to the base 220. Each area comprises a plurality of sections, wherein the area A comprises the sections A1~A3, the area B comprises the sections B1~B3 and the area C comprises the sections C1~C3. The backlight module 210 comprises the LED (Light-emitting Diode) and a plurality of optical films. Since the driving currents of the backlight module 210 possesses the characteristic of local dimming, therefore by adjusting the driving current of each section of the backlight module 210, the operating temperature of the LEDs of each section can be controlled in proximity to each other and the overall performance of the backlight module 210 can be improved immensely. The method of determining the driving currents of the backlight module 210 is explained according to the sections defined in FIG. 2.

Figure 3:
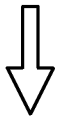
FIG. 3 is a diagram illustrating determining the driving currents of the backlight module according to the first embodiment of the present invention.

Please refer to FIG. 3. FIG. 3 is a diagram illustrating determining the driving currents of the backlight module according to the first embodiment of the present invention. In the first embodiment, the driving currents of the backlight module 210 are adjusted according to the distance difference between each area and the base 220. Since the backlight module 210 is disposed perpendicular to the ground surface and the hot air rises upwards, the areas further from the base 220 are of a higher temperature. Therefore, when determining the driving currents of the backlight module 210, the driving currents of the areas further from the base 220 is reduced. In other words, the magnitude of the driving currents is increased from areas that are further from the base 220 to areas that are closer to the base 220. For instances, assuming the driving current of the area A as the criterion (100%), the driving current of the area B is increased by 25%, the driving current of the area C is increased by 40% and the driving current of the sections of each area can be further adjusted slightly by around 10%. As illustrated in the driving current setting 300 of FIG. 3, the driving current of 55 mA for the section A2 is assumed to be 100% (the criterion), the driving current of 60 mA for the sections A1 and A3 is 109%, the driving current of 70 mA for the section B2 is 127%, the driving current of 68 mA for the sections B1 and B3 is 124%, the driving current of 80 mA for the section C2 is 145%, and the driving current of 75 mA for the sections C1 and C3 is 136%. The brightness and temperature are measured according to the driving current setting 300 as illustrated in FIG. 3, the maximum temperature difference is approximately 7.2° C., the brightness uniformity (maximum brightness/minimum brightness) is around 1.24; it is obvious that the maximum temperature difference is vastly improved compared to the prior art.

Figure 4:
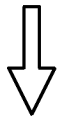
FIG. 4 is a diagram illustrating determining the driving currents of the backlight module according to the second embodiment of the present invention.

Please refer to FIG. 4. FIG. 4 is a diagram illustrating determining the driving currents of the backlight module according to the second embodiment of the present invention. In the second embodiment, the method of determining the driving currents of the backlight module is assumed to be similar to that of the first embodiment, but further improvements such as brightness enhancement of the central areas and power saving feature are also considered. For instances, assuming the driving current of the area A is the criterion (100%), the driving current of the area B is increased by 25%, the driving current of the area C is increased by 25%, and the driving current of the sections of each area can be further adjusted slightly to increase by around 10%. As illustrated in the driving current setting 400 of FIG. 4, if the driving current of 55 mA of the section A2 is assumed to be 100%, then the driving current of 60 mA of the sections A1 and A3 is 109%, the driving current of 72 mA of the section B2 is 130%, the driving current of 66 mA of the sections B1 and B3 is 120%, and the driving current of 70 mA of the sections C1, C2 and C3 is 127%. After the backlight module 210 is operated according to the driving current setting 400 of FIG. 4, the temperature and brightness of each area of the backlight module 210 is measured; the maximum temperature difference is 6.1° C., the brightness uniformity (maximum brightness/minimum brightness) is 1.24, and the brightness of the section B2 has significantly improved compare to its surrounding sections. In addition, since the currents of sections C1~C3 are lower, the backlight module 210 of the second embodiment of the present invention consumes less power compare to that of the first embodiment.

Figure 5:
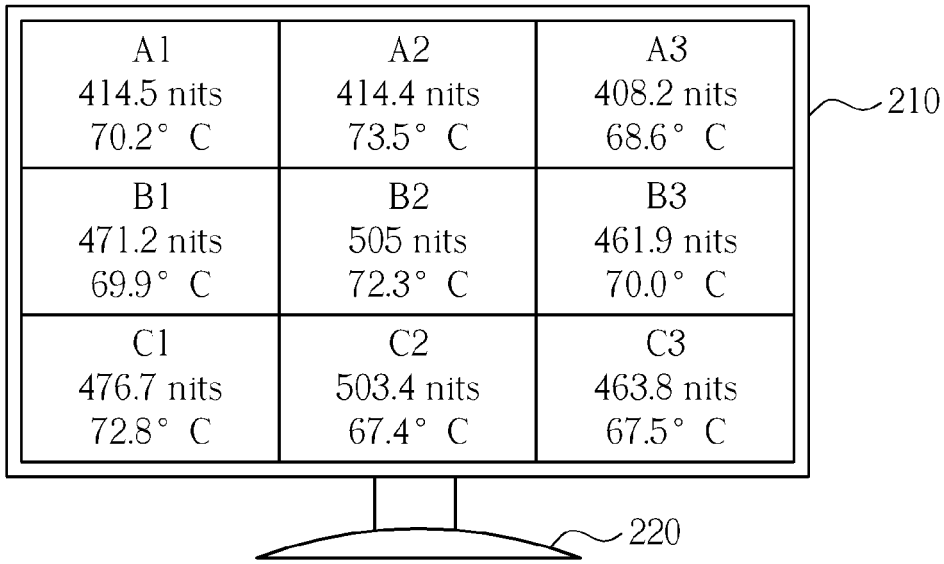
FIG. 5 is a diagram illustrating determining the driving currents of the backlight module according to the third embodiment of the present invention.

Please refer to FIG. 5. FIG. 5 is a diagram illustrating determining the driving currents of the backlight module according to the third embodiment of the present invention. Since the conventional LEDs utilize PWM (Pulse Width Modulation) for controlling the brightness, in the third embodiment the driving power of each section of the backlight module 210 is adjusted from setting the ratio of the turn-on time of the control signal of the PWM. On the other hand, each section of the backlight module 210 can still perform local dimming within the predetermined turn-on time. For instances, assuming each area comprises comparable driving currents, the power consumption of the light emitting component of each area of the backlight module 210 can be adjusted by reducing the turn-on time of the control signal of the PWM; therefore the turn-on time for area A is reduced by 20%, the turn-on time of the areas B and C remain unchanged, and the turn-on time for the sections of each area can be further adjusted slightly to be increased by around 10%. As illustrated by the driving current setting 500 in FIG. 5 wherein the brightness of the central area is increased, the driving current of each section is 75 mA, the turn-on time of the section A2 is 77%, the turn-on time of the sections A1 and A3 are both 80%, the turn-on time of the section B2 is 100%, the turn-on time of the sections B1 and B3 are 87% and the turn-on time of the sections C1, C2 and C3 are 96%. After the backlight module 210 is operated according to the driving current setting 500 of FIG. 5, the temperature and brightness of each section of the backlight module is measured, wherein the maximum temperature difference is 6.1° C., and the brightness uniformity (maximum brightness/minimum brightness) is 1.24.

Figure 6:
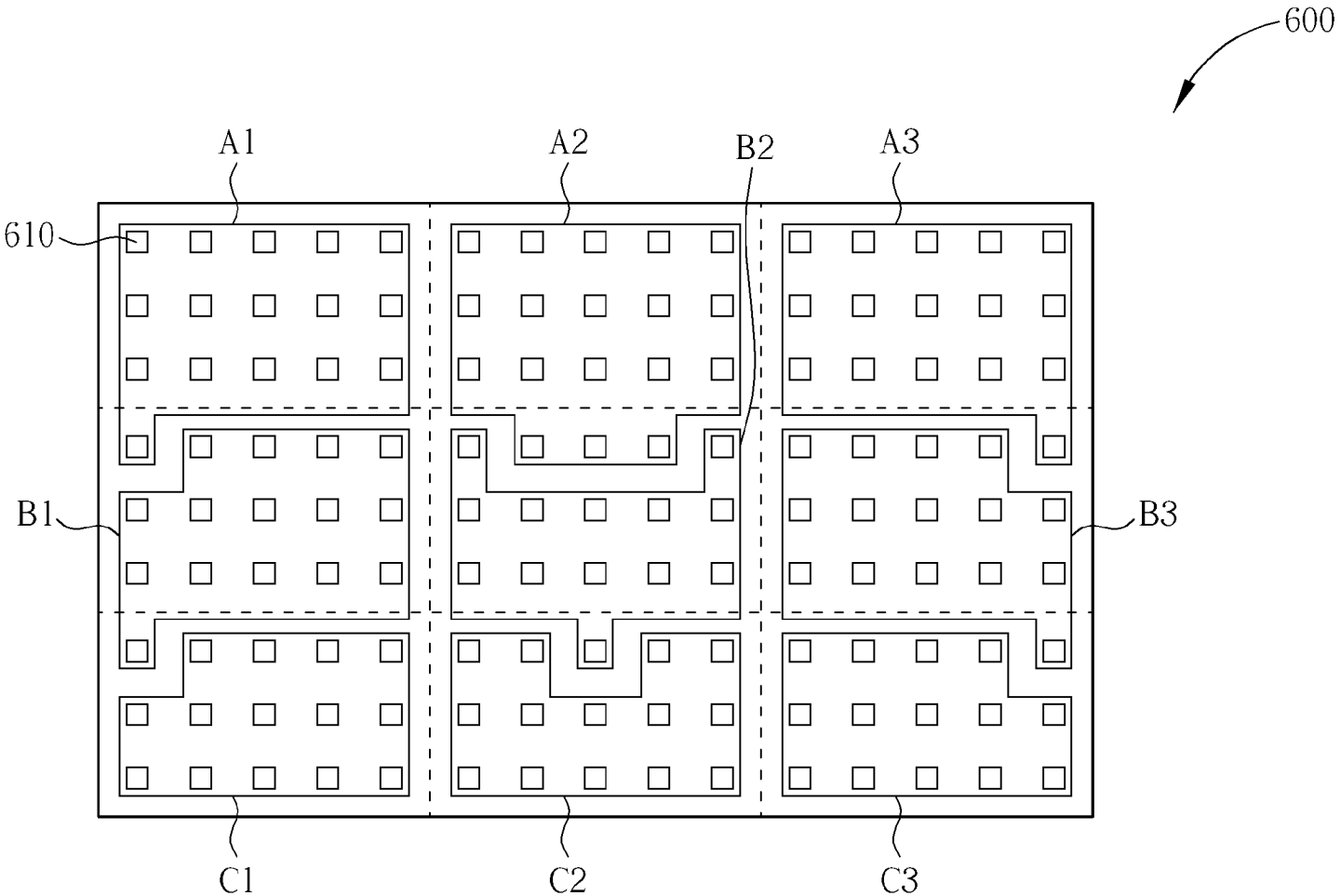
FIG. 6 is a diagram illustrating determining the driving currents of the backlight module according to the fourth embodiment of the present invention.

Please refer to FIG. 6. FIG. 6 is a diagram illustrating determining the driving currents of the backlight module according to the fourth embodiment of the present invention. In the fourth embodiment, for simplifying the circuit control of the LEDs as well as keeping the driving current of each area uneven, when multiple sections of LEDs are coupled in parallel the more LEDs that are coupled in series in each area the lower the driving current is reduced to. Therefore, adjusting the driving current of each section can also be achieved by controlling the amount of LEDs coupled in series in every section of the backlight module. Furthermore, fine-tuning the driving current of each section can be more easily accomplished by coupling resistors in series to the LEDs that are coupled in series of each section, and such resistors can also stabilize the voltage of the heated LEDs. As illustrated in FIG. 6, the backlight module 600 comprises sections A1~A3, B1~B3, C1~C3; when the driving current of each section remains unadjusted (as shown by the dotted line), each section is coupled to 15 LED modules 610. Assuming the goal is to achieve the driving current ratio similar to the second embodiment, each of the sections A1 and A3 is coupled in series to 16 LED modules 610, the section A2 is coupled in series to 18 LED modules 610, each of the sections B1 and B3 is coupled in series to 15 LED modules 610, and the section B2 is coupled in series to 13 LED modules 610. A resistor can be coupled to the input end or the output end of the LED circuit of each section for fine tuning the driving currents.

Figure 7:
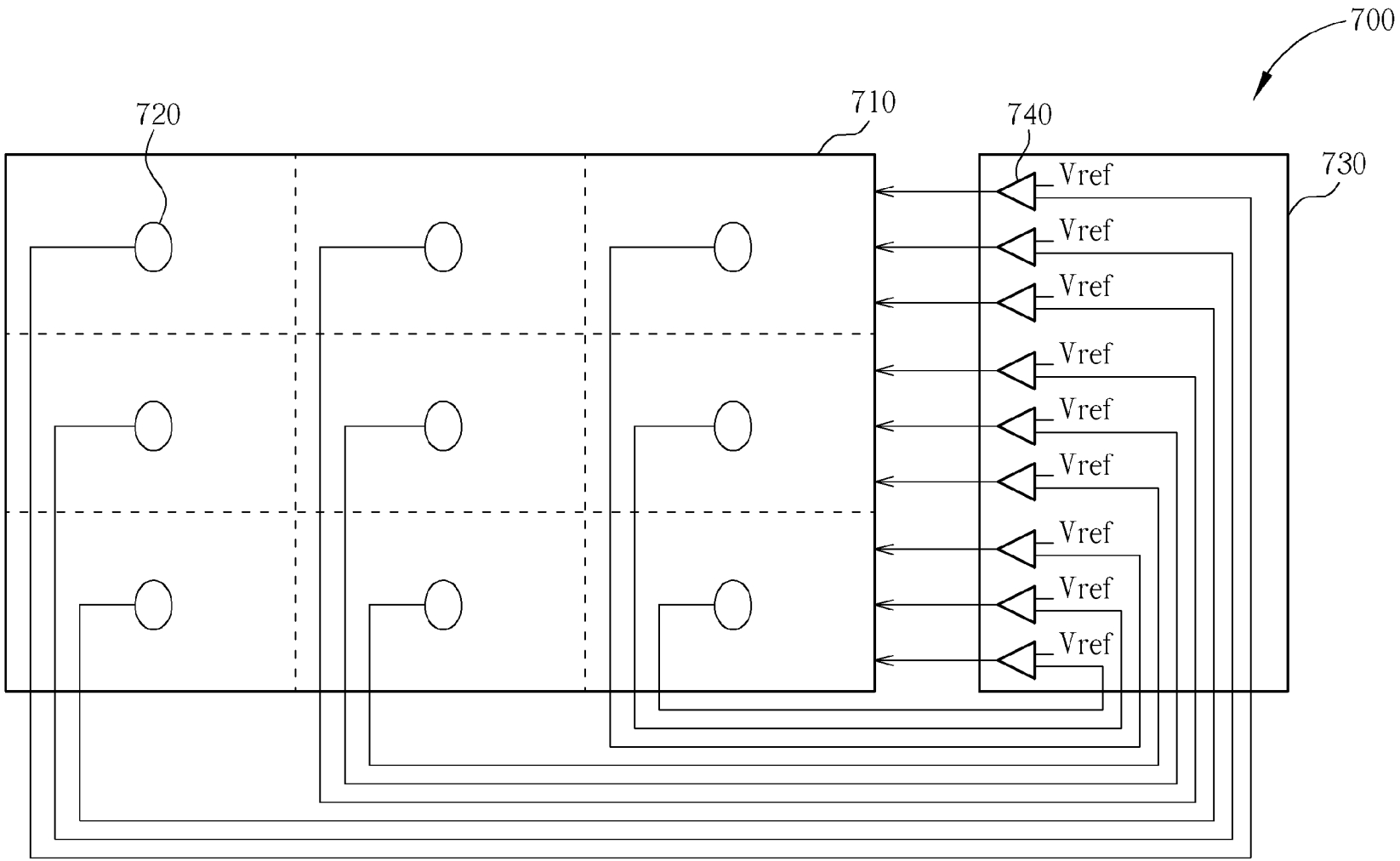
FIG. 7 is a diagram illustrating determining the driving currents of the backlight module according to the fifth embodiment of the present invention.

Please refer to FIG. 7. FIG. 7 is a diagram illustrating determining the driving currents of the backlight module according to the fifth embodiment of the present invention. In the first to the fourth embodiments mentioned above, the driving current of each section of the backlight module are predetermined for circulating the temperature of the backlight module evenly as well as optimizing the brightness of the backlight module. In the fifth embodiment, the backlight module 700 comprises the light emitting module 710, the temperature sensor 720 and the driver 730. The light emitting module 710 is comprised by LEDs and possesses the characteristic of being able to perform local dimming. The light emitting module 710 comprises a plurality of sections of LEDs and a temperature sensor 720 is disposed close to each section. The feedback signal generated by each temperature sensor 720 is compared with a reference voltage Vref by the comparator 740, so as to calculate the current temperature of the light emitting component and the current value that is appropriate to each section can then be interpolated. The driver 730 then controls the driving current or the PWM turn-on ratio according to the adjusted current value. For instances, when the temperature measured by the temperature sensor 720 increases, the driver 730 accordingly lowers the driving current or the ratio of the turn-on time for PWM of the corresponding section, so ultimately the temperature measured by the temperature sensor 720 are approximately even for each section for keeping the LEDs of each section to operate in the appropriate temperature.

In conclusion, the present invention discloses a method for determining driving currents of a backlight module. The method comprises disposing the backlight module onto a base; defining a plurality of areas from a top area to a bottom area of the backlight module; and reducing the driving current of an area that is further from the base. The embodiments of the present invention disclose that by utilizing the characteristic of the control current of the LEDs being able to perform local dimming, the driving current or the turn-on time of a control signal for PWM of each area of the LEDs can be predetermined for optimization, so the overall performance of the backlight module can be improved. Furthermore, the embodiments of the present invention also provides the backlight module with temperature sensors, so the driver can simultaneously adjust the driving current of the backlight module according to the temperature measured by the temperature sensor, for the temperature measured by the temperature sensor to approximately equal to each other.

Those skilled in the art will readily observe that numerous modifications and alterations of the device and method may be made while retaining the teachings of the invention.

What is claimed is:

1. A method of determining driving currents of a backlight module, comprising:

disposing the backlight module vertically, the backlight module comprising m areas from top to bottom of the backlight module, each area comprising n sections from left to right of the area; and adjusting driving currents of m×n sections separately, wherein when a temperature of one of the sections rises, the driving current of the section is reduced;

wherein m≥2; n≥2;

wherein the areas comprise a middle area disposed between a top area and a bottom area, the top area comprises a first section, a second section and a third section, the middle area comprises a fourth section, a fifth section and a sixth section, and the bottom area comprises a seventh section, an eighth section and a ninth section;

wherein the fifth section is disposed between the fourth section and the sixth section;

wherein a driving current of the fifth section is greater than driving currents of the seventh section, the eighth section and the ninth section;

wherein the driving currents of the seventh section, the eighth section and the ninth section are greater than driving currents of the fourth section and the sixth section; and wherein the driving currents of the fourth section and the sixth section are greater than driving currents of the first section, the second section and the third section.

* * * * *